US011701758B2

(12) United States Patent
Mueck et al.

(10) Patent No.: US 11,701,758 B2
(45) Date of Patent: Jul. 18, 2023

(54) PORTABLE POWER TOOL

(71) Applicant: C. & E. Fein GmbH, Schwaebisch Gmuend-Bargau (DE)

(72) Inventors: Michael Mueck, Wangen (DE); Frank Walz, Heubach (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 295 days.

(21) Appl. No.: 17/101,776

(22) Filed: Nov. 23, 2020

(65) Prior Publication Data

US 2021/0154807 A1 May 27, 2021

(30) Foreign Application Priority Data

Nov. 22, 2019 (DE) ..... 20 2019 106 525.7

(51) Int. Cl.

| | |
|---|---|
| ***B25B 21/00*** | (2006.01) |
| ***B25F 5/00*** | (2006.01) |
| ***B25B 23/14*** | (2006.01) |
| ***B25B 23/147*** | (2006.01) |

(52) U.S. Cl.

CPC ..... *B25B 21/00* (2013.01); *B25B 23/141* (2013.01); *B25B 23/147* (2013.01); *B25F 5/001* (2013.01)

(58) Field of Classification Search

CPC ..... F16D 43/204; B25B 21/00; B25B 21/141; B25B 21/147; B25B 23/0064; B25B 23/14

USPC ..... 81/54, 473, 467, 474; 192/56.1; 173/178

See application file for complete search history.

(56) References Cited

U.S. PATENT DOCUMENTS

| | | | | |
|---|---|---|---|---|
| 2,820,381 | A * | 1/1958 | White | B25B 23/1427 81/474 |
| 3,442,362 | A * | 5/1969 | Bangerter | F16D 7/08 91/59 |
| 3,596,542 | A * | 8/1971 | Wallace | B25B 23/145 81/474 |
| 4,655,103 | A * | 4/1987 | Schreiber | F16D 43/2022 81/473 |
| 5,372,206 | A | 12/1994 | Sasaki et al. | |
| 5,505,676 | A * | 4/1996 | Bookshar | F16D 43/206 192/56.62 |

(Continued)

FOREIGN PATENT DOCUMENTS

| | | |
|---|---|---|
| DE | 4333599 A1 | 4/1994 |
| DE | 19845018 C1 | 12/1999 |
| DE | 10124569 A1 | 11/2002 |

*Primary Examiner* — Don M Anderson
*Assistant Examiner* — Jason Khalil Hawkins
(74) *Attorney, Agent, or Firm* — Muncy, Geissler, Olds & Lowe, P.C.

(57) ABSTRACT

An electric portable power tool, having a housing, a shaft, a control cam, an electric drive accommodated in the housing to drive the drive shaft, and an output unit that is positively connected with the drive via a mechanical shut-off clutch to transfer torque from the drive to an insertion tool connected with the output unit. The mechanical shut-off clutch comprises a control ring that is axially mounted against the force of the return spring and at least one switch element that is run on the control cam. The control cam is delimited at one end by a first switching contour for providing a release torque of the shut-off clutch and by a boundary contour at another end. The control cam is associated with a second switching contour for providing a pre-torque which is less than the release torque.

15 Claims, 11 Drawing Sheets

(56) References Cited

U.S. PATENT DOCUMENTS

| | | | | |
|---|---|---|---|---|
| 6,085,849 | A * | 7/2000 | Scigliuto | B25B 23/145 192/150 |
| 6,176,162 | B1 | 1/2001 | Ludwig et al. | |
| 6,662,882 | B2 * | 12/2003 | Hansson | B25B 23/14 173/176 |
| 7,665,392 | B2 * | 2/2010 | Tokunaga | F16D 7/08 81/474 |
| 10,801,552 | B2 * | 10/2020 | Walz | F16D 43/218 |
| 2006/0090615 | A1 * | 5/2006 | Yamada | B25B 23/0035 81/475 |

* cited by examiner

PORTABLE POWER TOOL

This nonprovisional application claims priority under 35 U.S.C. § 119(a) to German Patent Application No. 20 2019 106 525.7, which was filed in Germany on Nov. 22, 2019, and which is herein incorporated by reference.

BACKGROUND OF THE INVENTION

Field of the Invention

The present invention relates to an electrical portable power tool, in particular a cordless screwdriver, with a preferably electric drive accommodated in a housing, which drives a drive shaft, with an output unit which can be positively connected to the drive by means of a mechanical shut-off clutch in order to transfer torque from the drive to an insertable tool connected with the output unit, wherein the mechanical shut-off clutch comprises a control ring which is axially supported against the force of a return spring and at least one switch element guided on a control cam, the control cam being limited at one end by a first switching contour for providing a release torque of the shut-off clutch, and at the other end by a boundary contour.

Description of the Background Art

In screwdrivers, in particular cordless screwdrivers, which are used for industrial series screw fastenings, for example in the production of automobiles, there is a need to reliably form screw fastenings, i.e. at a defined tightening torque, with a very high repeatability and the highest possible screw-in speed. Such a cordless screwdriver is known, for example, from DE 101 24 569 A1. In this case, a mechanical shut-off clutch is often used, which enables a separation of the power transmission between the drive and the output unit when exceeding a predefined tightening torque. This shut-off clutch comprises a control ring which, when the predefined tightening torque is exceeded, is adjusted axially against the force of a return spring, thereby enabling the shut-off clutch, i.e. opening or releasing it. To open the shut-off clutch, therefore, the torque of the drive train must ultimately overcome the force of the return spring. With increasing torque, which is introduced in the shut-off clutch, the introduced torque is thus transferred to the control ring until the force of the return spring, which counteracts the control ring in the axial direction, is less than the force component that results in the axial direction due to the applied torque. The control ring is then axially deflected against the force of the return spring and there is a relative rotation between the first switching contour and the switch element.

This axial displacement of the control ring and, ultimately, the opening of the shut-off clutch is commonly used as a sensor signal to switch off the drive and, if necessary, to brake it and thus bring it to a halt. Various techniques are used here. In particular, a microswitch can be used here for switching, or a magnetic field can also be changed by the axial deflection. In the context of the present invention, it is also provided that during the axial displacement of the control ring, a slider control with a magnet received therein is axially deflected. Using a Hall sensor, the change in the magnetic field induced by the axial deflection of the magnet is able to detect what can be used as a sensor signal for switching off the drive.

After releasing the shut-off clutch, the control ring is axially pushed back in the direction of the drive by the force of the return spring and forces the switch element back to the control cam. The part of the shut-off clutch connected to the drive in a rotationally fixed manner is then rotated further by the existing rotational energy of the drive until the motor comes to a standstill. At a low speed of the drive, the drive is switched off and stopped so rapidly that a renewed release of the shut-off clutch is avoided. To ensure a defined screwing process, after a short time, the drive is also frequently further operated at a very low speed until the first switching contour again bears on the switch element. The shut-off clutch is now in its starting position for the next screw fastening.

However, when the screwing process is carried out at too high a screw-in speed, there is a risk that the rotational energy is so great that, after releasing the shut-off clutch, the braking time is no longer sufficient to bring the motor to a standstill in a timely manner such that the shut-off clutch is actually released only once. In these cases, rather, the shut-off clutch is released at least once more, before the drive is braked and comes to a standstill. The repeated release of the shut-off clutch, however, leads to an increased tightening torque and thus to process instability within the screwing process. In addition, the release of the shut-off clutch is associated with an acoustic effect, which can usually be referred to as a clacking noise. If the shut-off clutch is released repeatedly, this is often irritating for the user since by hearing the clicking sound multiple times, the user assumes that the screw fastening has been performed incorrectly.

SUMMARY OF THE INVENTION

It is therefore an object of the present invention to reduce the aforementioned disadvantages, in particular to provide a portable power tool which provides improved process reliability at high screwing speeds.

This object is achieved according to the invention by a portable power tool of the type mentioned above in that the control cam is assigned a second switching contour for providing a pre-torque, which is less than the release torque.

By means of the second switching contour, ultimately a pre-torque is provided, which also leads to axial deflection of the control ring mounted axially against the force of the return spring. This additional axial deflection can now be used to generate a pre-switching signal well before the actual release torque is reached, which ultimately corresponds to the tightening torque, in order to switch off or brake the drive at this early point in time or at least prepare for these steps. In the context of the invention, however, it is alternatively or additionally provided, in addition to the detection of the axial adjustment of the control ring, to also detect a relative rotation of the control ring with respect to the part of the shut-off clutch that is non-rotatably connected to the drive shaft. This relative rotation ultimately occurs when the pre-torque is exceeded and the switch element slides over the second switching contour and then comes to rest on the first switching contour. By means of the second switching contour, therefore, increasing torque can be detected even before the shut-off clutch is actually released, in order to initiate or prepare for the shutdown or braking of the drive.

It has also proven to be advantageous if the first switching contour has a switching point, the tangential slope of which defines the release torque of the shut-off clutch, and if the control cam is assigned a second switching contour with a switching point, the tangential slope of which defines the pre-torque, which is less than the release torque. Since the slope of the tangent at the pre-switching point can determine the release torque or the pre-torque, a simple option is provided for defining the release torque and the pre-torque. In this connection, it has then proven advantageous if the tangential slope in the switching point is greater than the tangential slope in the pre-switching point. If the stroke of the second switching contour is the same as or less than that of the first switching contour, this ensures that when the second switching contour is released, the pre-torque can be clearly distinguished from the release torque of the first switching contour.

It has also proven useful if the ratio between the tangential slope of the switching point and the tangential slope of the pre-switching point is preferably 1.2:1 or greater, preferably 1.5:1 or greater, and particularly preferably 1.8:1 or greater and more preferably 4:1 or less, preferably 3:1 or less and most preferably 2:1. This ensures that the value of the pre-torque is significantly lower than the value of the release torque so as to be able to reliably differentiate between the pre-torque and the release torque.

In addition, it has also proven to be advantageous if the angle between the tangential slope of the switching point and a plane which is oriented perpendicular to the drive shaft is preferably 50° or greater, preferably 55° or greater and particularly preferably 60° or greater and further preferably 80° or less, preferably 75° or less, and particularly preferably 70° or less. If this angle becomes too great, there is the risk that the switch element can only slide with difficulty over the first switching contour when the shut-off clutch is released, so that in particular the release torque increases too much. In this connection, it has then proven to be particularly advantageous when the angle between the tangential slope of the pre-switching point and a plane which is oriented perpendicular to the drive shaft is preferably 20° or greater, preferably 25° or greater, and particular preferably 30° or greater and more preferably 45° or less, preferably 40° or less, and particularly preferably 35° or less. This also ensures that a suitable distinction can be made between the pre-torque and the release torque.

In terms of production technology, it has also been shown to be advantageous if the control cam in the area of the second switching contour has a constant incline. In particular, this can be implemented particularly easily in terms of production technology. In addition, the characteristic increase in torque that occurs as a result of this makes it possible to detect that the switch element is located in the area of the second switching contour, as a result of which the shutdown and/or braking of the drive can then be initiated or executed. Moreover, by detecting and evaluating the temporal duration of the axial deflection of the control ring at a known screw-in speed, conclusions in terms of the torque rate can be drawn. The faster the axial deflection, the harder the screw joint. This ultimately allows for the shutdown or braking behavior of the drive to be controlled as a function of the hardness of the screw joint. Thus, in a hard joint—i.e. with a rise in a short amount of time—early and strong braking can be initiated, while in a soft screw joint—i.e. with a rise in a long amount of time—the braking operation can take place later or be weaker or can be omitted completely. The shutdown or braking of the drive is controlled by electronics in the portable power tool.

However, it has also proven to be favorable if the control cam comprises a first maximum, which defines the release torque, and a second maximum, which defines the pre-torque. By using two maxima, it is ultimately achieved that the deflection of the control ring, which is axially adjustable against the spring force of the return spring by means of the second switching contour, can be significantly shifted in time by the first switching contour up to a point before the deflection. In this context, however, it has also proven particularly useful when the first maximum is greater than the second maximum. This reflects the fact that the switching signal is generated by the deflection of the axially displaceable control ring, i.e. ultimately, the axial deflection of the control ring is to be detected. Due to the different height of the maxima, a distinction can then be made between the pre-torque and the release torque. In addition, the maxima can more easily detect a relative rotation between the adjusting ring and the part of the shut-off clutch that is connected to the drive shaft in a rotationally fixed manner.

It has also proven to be advantageous if the ratio between the height of the first maximum and the height of the second maximum is preferably 1.5:1 or greater, preferably 3:1 or greater and particularly preferably 4:1 or greater and more preferably 10:1 or less, preferably 8:1 or less, and more preferably 6:1 or less and most preferably 5:1. This also ensures that a clear distinction can be made between the pre-torque and the release torque, which ultimately reduces the risk that the axial deflection of the control ring induced by the pre-torque is maintained for the movement induced by the release torque.

In the context of the invention, it has also proven to be particularly advantageous if the amount of the derivation of the profile of the control cam in the area of the first switching contour and the second switching contour is greater than 0. This ultimately provides a continuously increasing control cam between the two switching contours in which, however, both the pre-torque as well as the release torque are in each case delimited by a clearly defined switching contour. In addition, this ensures that after the shut-off clutch is released and the drive is shut down and braked, the switch element cannot permanently move into an intermediate position between the first switching contour and the second switching contour. This would then lead to the fact that due to the intermediate position of the switch element, the second pre-torque could not be used in a further screwing process, which would result in the risk that the subsequent screwing process not being completed in time and the shut-off clutch being released multiple times.

It has also proven useful if the second derivation of the control cam profile in the area of the first switching contour and the second switching contour is greater than or equal to 0. This ultimately leads to a continuous increase in the incline—and thus the torque acting on the switch element.

It has also proven to be advantageous if the switch element and the control cam are provided multiple times, in particular three times. In this way, besides a symmetrical construction of the shut-off clutch, in particular also an improved transfer of torques is achieved.

As it has also been found advantageous if the boundary contour of an adjacent second cam is formed on the first switching contour of a first control cam. This further reduces the production effort in particular. In this context, it has also been shown to be advantageous if the edge of the boundary contour is steeper than the first switching contour. This achieves that, when reversing the direction of the drive—i.e. for dissolving an existing screw fastening—the release torque is greater than the tightening torque of the screw fastening.

It has also been shown to be particularly favorable if the shut-off clutch comprises a cam ring which is connected to the drive shaft in a rotationally fixed manner and on which the control cam is formed. The preferably axially nondisplaceable cam ring in particular creates a functional division that prevents mechanical overloading of the individual components. In this context, it has also been shown to be advantageous if the switch element is designed as a switching ball. In the context of the invention, however, it is also provided that the switch element is designed, for example, as a switching cylinder that is guided on the control cam.

It has also proven useful if the return spring is designed as a compression spring whose spring force is adjustable. In particular, by means of the adjustability of the spring force, it can be achieved that various screw fastenings can be performed with the portable power tool.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
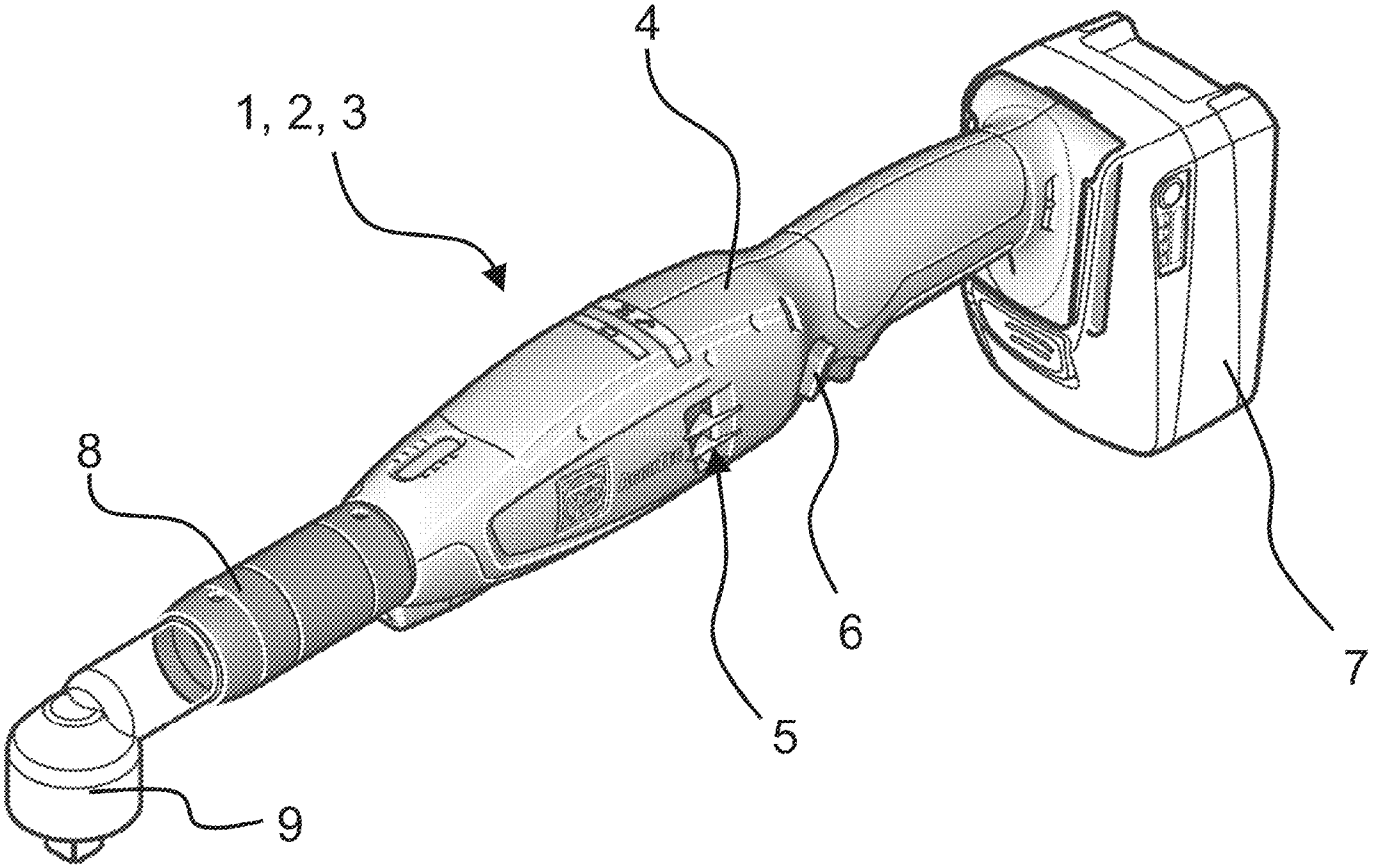
FIG. 1 is a perspective view of a portable power tool.

FIG. 1 shows a perspective view of an electrical portable power tool 1 which, in the exemplary embodiment shown, is formed as an industrial cordless screwdriver 2 with high precision, more precisely as an angle screwdriver 3, which is usually used in industrial series screw fastenings. This angle screwdriver 3 has a drive 5 accommodated in a housing 4, the direction of rotation of which can be adjusted by means of an adjusting switch 6 in order to give the user the option of loosening a screw fastening again. The electric energy required to supply the drive 5 with power is provided in the shown embodiment by a rechargeable battery 7, which is removably mounted on the angle screwdriver 3. At the end of the angle screwdriver 3 facing away from the battery 7, a receptacle 8 is formed by means of which different attachments or insertion tools can be connected. In the exemplary embodiment shown, this is an angle head 9, for example.

Figure 2:
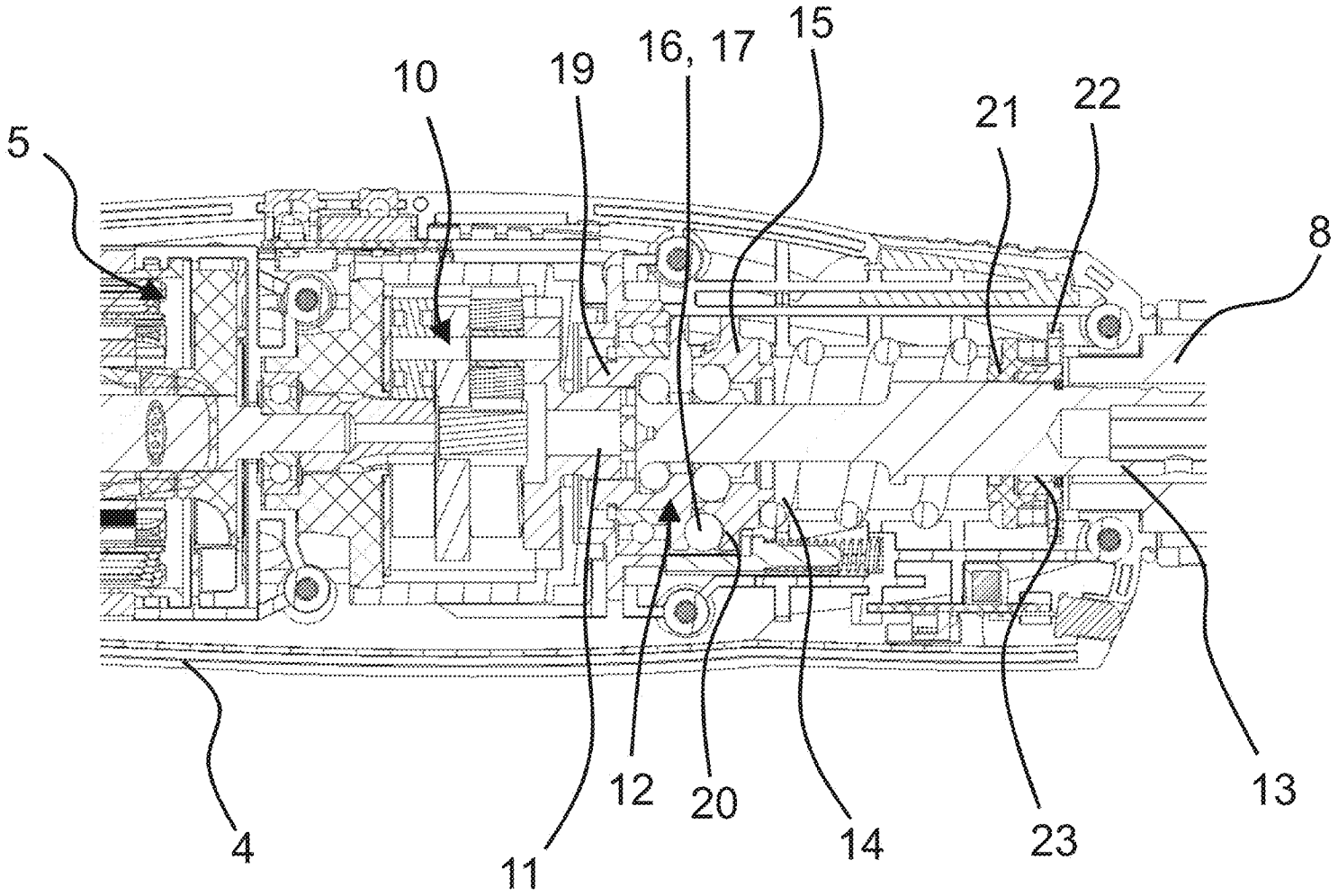
FIG. 2 shows a section of a longitudinal section through the portable power tool of FIG. 1.

The detail of a longitudinal section through the angle screwdriver 3 displayed in FIG. 2 shows that the drive 5 drives a drive shaft 11 via a gearbox 10. The drive shaft 11 is positively connected via a mechanical shut-off clutch 12 with an output unit 13. This output unit 13 ends in the receptacle 8, to which the various attachments or tools can be attached.

Figure 3:
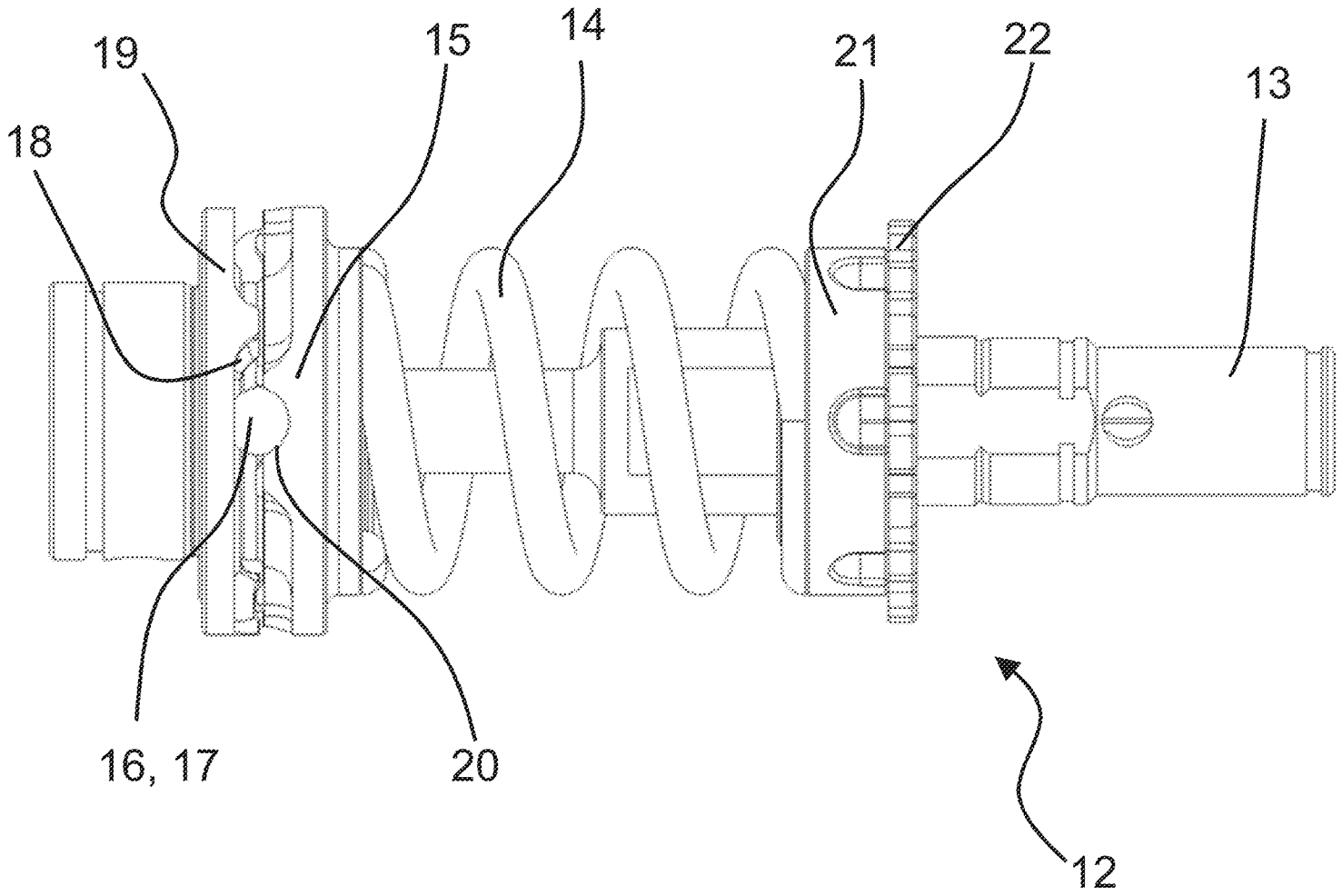
FIG. 3 is a side view of a first embodiment of a shut-off clutch.

As can also be seen in particular from FIG. 3, which shows a first embodiment of the shut-off clutch 12, the latter comprises a control ring 15 mounted axially against the force of a return spring 14, which is essentially designed to be rotationally fixed to a switch element 16, which in the embodiment is shown as a switching ball 17. The switching ball 17 runs on a control cam 18 which is formed on a cam ring 19 that is non-rotatably connected to the drive shaft 11. The torque applied by the drive 5, coming from the gearbox 10, is introduced in the shut-off clutch 12 on the cam ring 19 and, with a closed shut-off clutch 12, is ultimately transferred to the output unit 13. In this case, the torque is transferred via the switch element 16 from the control cam 18, which is formed on the cam ring 19, to the control ring 15, which is provided in triplicate in the exemplary embodiment shown. The switch elements 16 are each captively received on the control ring 15 in a ball pocket 20, though they have some degree of freedom of motion. As already mentioned above, the control ring 15 is axially mounted on the output unit 13 against the force of the pretensioned return spring 14, which is mounted between the control ring 15 and a pressure ring 21. The axial position of the pressure ring 21 in the direction of the receptacle 8 is limited by means of an adjusting ring 22, which is adjustably mounted on the output unit 13 via a threaded connection 23. The axial position of the pressure ring 21 and therefore the spring tension of the return spring 14 can thus be changed by the adjusting ring 22. In this way, the tensioned length of the return spring 14, and thus the axial pretensioning force of the return spring 14 onto the control ring 15, can be adjusted. This allows for the release torque and thus the screwing torque to be set. The cam ring 19 is rotatably mounted against the output unit 13 to allow for the relative rotation required for releasing the shut-off clutch 12. The control cam 18 is delimited at one end by a first switching contour 24 and by a boundary contour 25 at the other end. The release torque of the shut-off clutch 12, which corresponds to the screwing torque, is ultimately provided by the first switching contour 24. In addition to the first switching contour 24 and the boundary contour 25, the control cam 18 includes a second switching contour 26, the function of which in particular will be explained in more detail below with reference to FIGS. 4 to 8.

Figure 4:
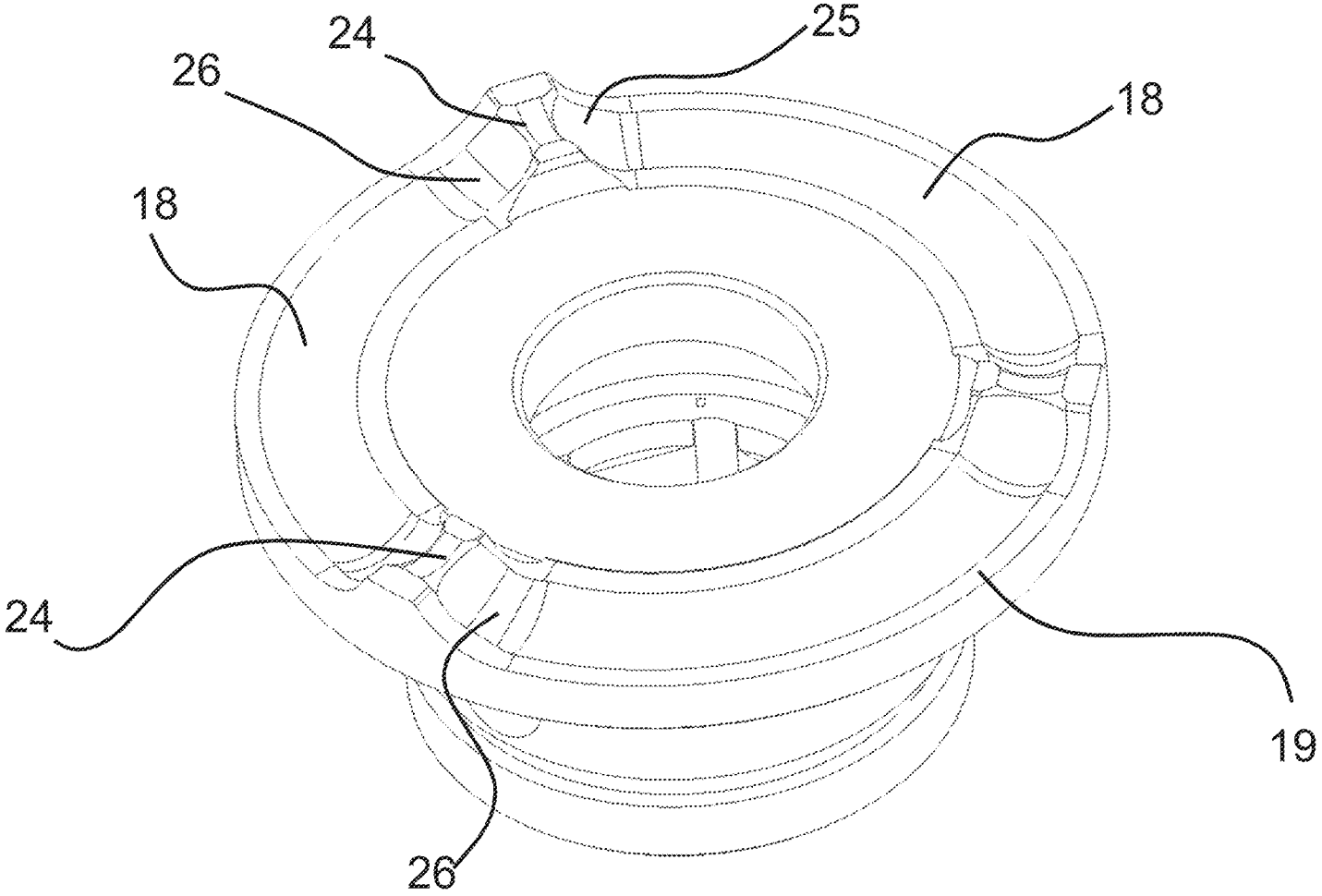
FIG. 4 is a perspective view of a control cam of the first embodiment of the shut-off clutch.

FIG. 4 shows, in particular, the second switching contour 26, which is formed between the boundary contour 25 and the first switching contour 24. This second switching contour 26 provides a pre-torque that is less than the release torque. Whereas the control cam 18 in the area of the first switching contour 24 has a profile with a curvature or radius adapted to the switch element 16, the control cam 18 in the area of the second switching contour 26 has a constant incline, and is therefore ultimately formed as a straight line. The amount of the derivation of the profile of the control cam 18 in the area of the first switching contour 24 and the second switching contour 26 is thereby consistently greater than 0, and the second derivation of the profile of the control cam 18 in the area of the first switching contour 24 and the second switching contour 26 is greater than or equal 0. It can also be seen from FIG. 4 that the boundary contour 25 of an adjacent second control cam 18 is formed on the first switching contour 24 of a first control cam 18.

Figure 5:
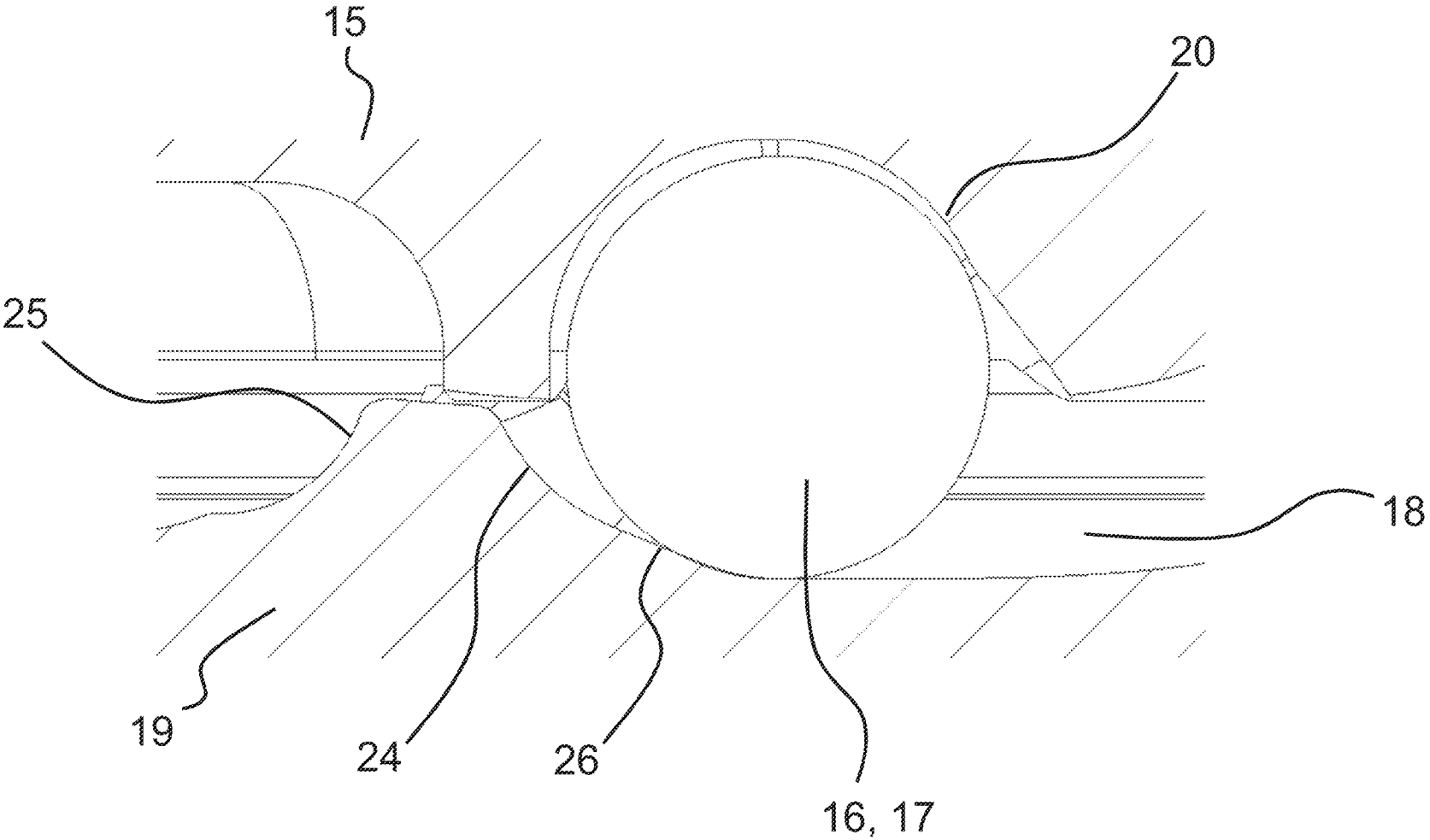
FIG. 5 shows a first switching state of the first embodiment of the shut-off clutch.
Figure 6:
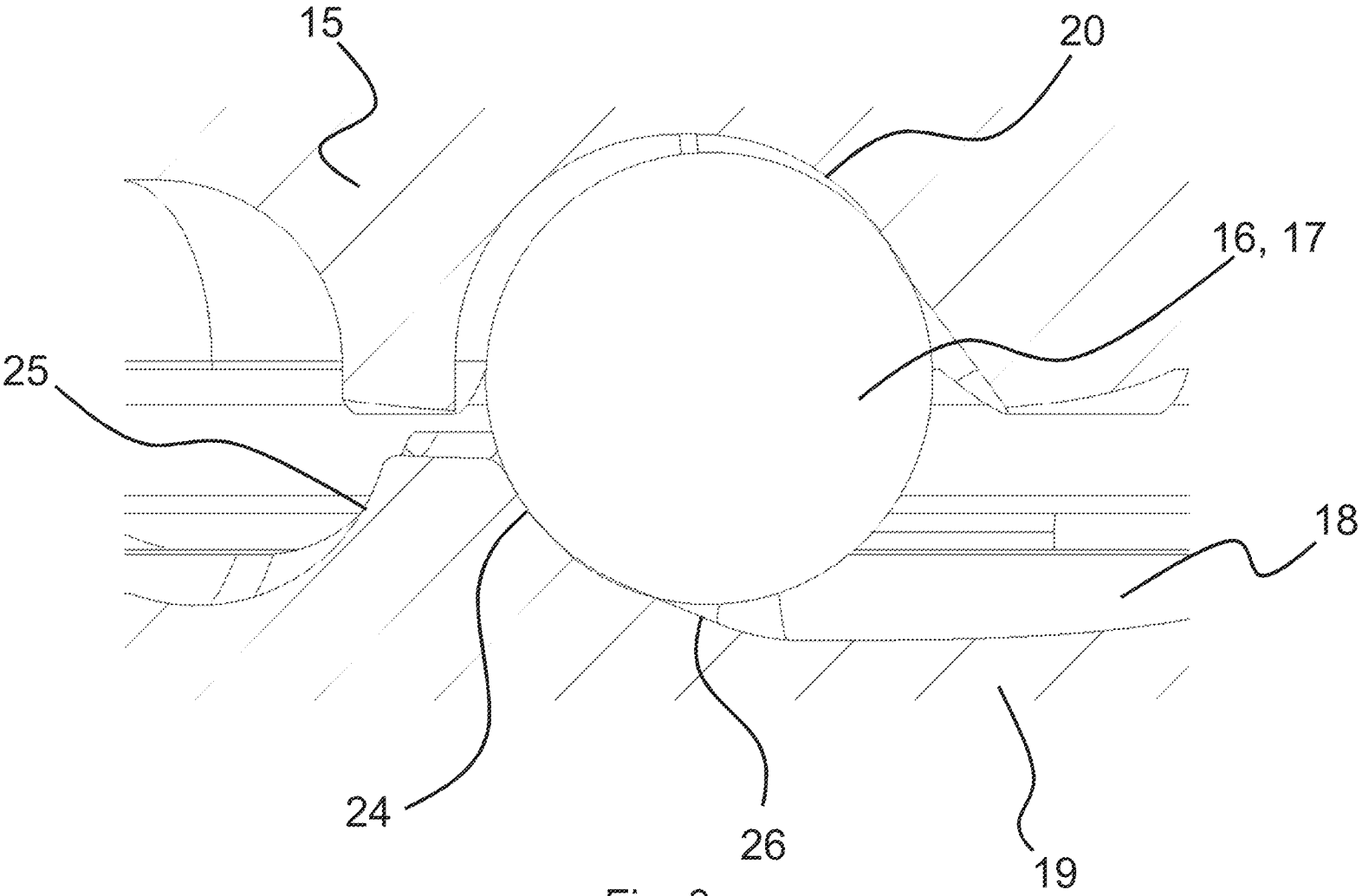
FIG. 6 shows a second switching state of the first embodiment of the shut-off clutch.
Figure 7:
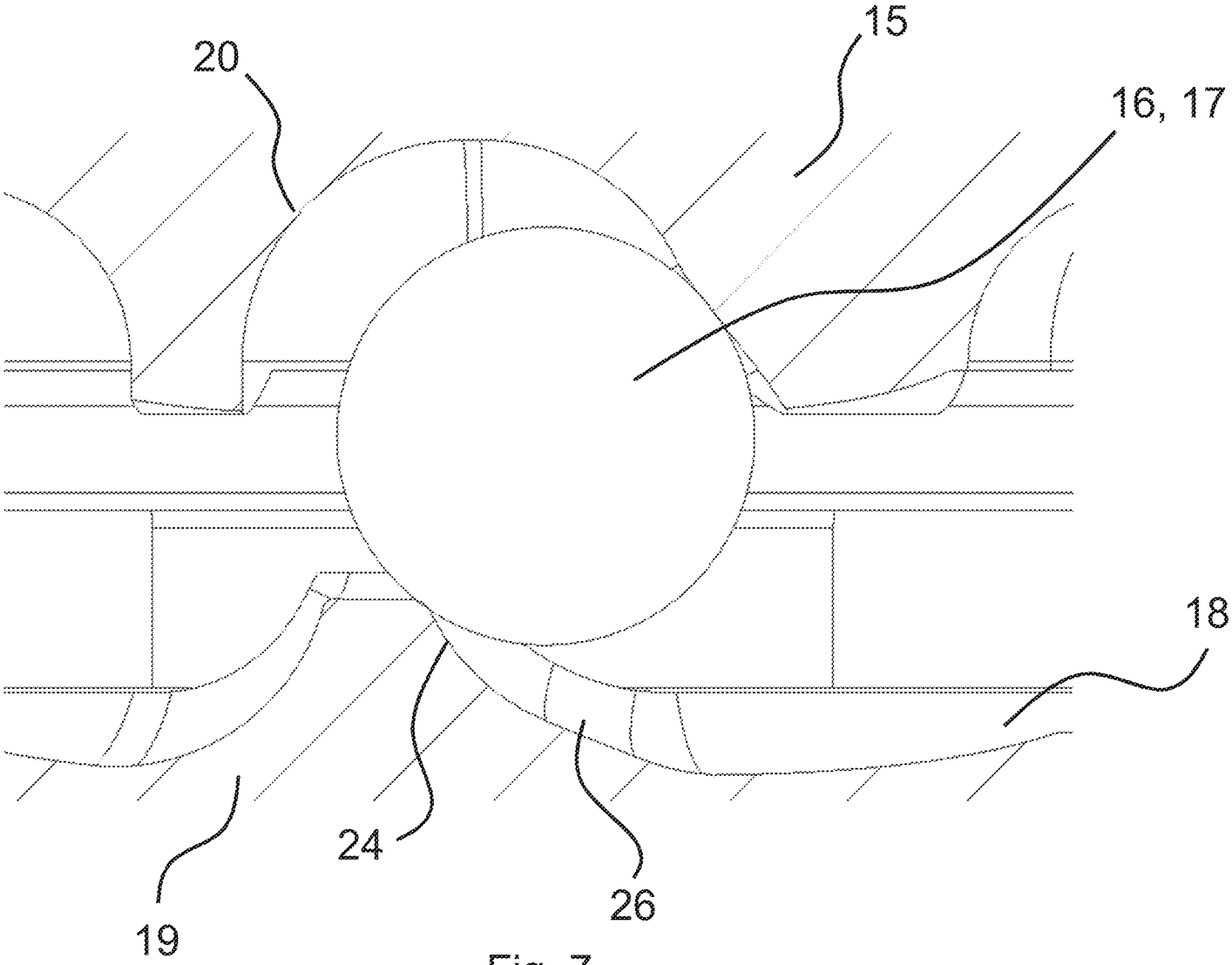
FIG. 7 shows a third switching state of the first embodiment of the shut-off clutch.

FIGS. 5 to 7 show the sequence of the releasing behavior of the portable power tool 1 according to the invention, which is realized by the control cam 18. FIG. 5 shows the state of the shut-off clutch 12 during the screw fastening. In this case, the switch element 16 rests on the second switching contour 26, which defines the pre-torque, and the torque is transferred from the drive 5 via the gearbox 10 and the closed shut-off clutch 12 to the output unit 13. The torque of the drive 5 introduced on cam ring 19 is transferred to the control ring 15 until the pre-torque is exceeded. The switch element 16 then slides onto the second switching contour 26, as shown in FIG. 6. In this case, the control ring 15 is axially adjusted against the force of the return spring 14. This axial displacement of the control ring 15 can now be detected, for example by means of a magnet and a corresponding Hall sensor, and be used to already prepare or initiate the shutdown and the braking of the drive 5 at this early stage by means of corresponding drive electronics. When the actual release moment is then reached, i.e. when the switch element 16 slides beyond the first switching contour 24, the control ring 15 is further axially adjusted against the force of the return spring 14. This can be seen in particular in FIG. 7. This displacement is now also detected, for example, by the above-mentioned magnet and the Hall sensor, and the shutdown and braking of the drive 5 is completed and the screw fastening is thus ended. The force of the return spring 14 then pushes the control ring 15 with the switch element 16 back onto the control cam 18 of the cam ring 19. The second switching contour 26 thereby ensures that a signal earlier in time for the braking of the drive shaft 11 takes place early enough so that the repeated release of the shut-off clutch 12 is avoided. The drive 5 continues to rotate the cam ring 19 at a very low speed until the second switching contour 26 of the switch element 16 is reached. There it comes to a standstill. The shut-off clutch 12 is now in its starting position for the next screw fastening in which the switch element 16 rests against the second switching contour 26.

Figure 8:
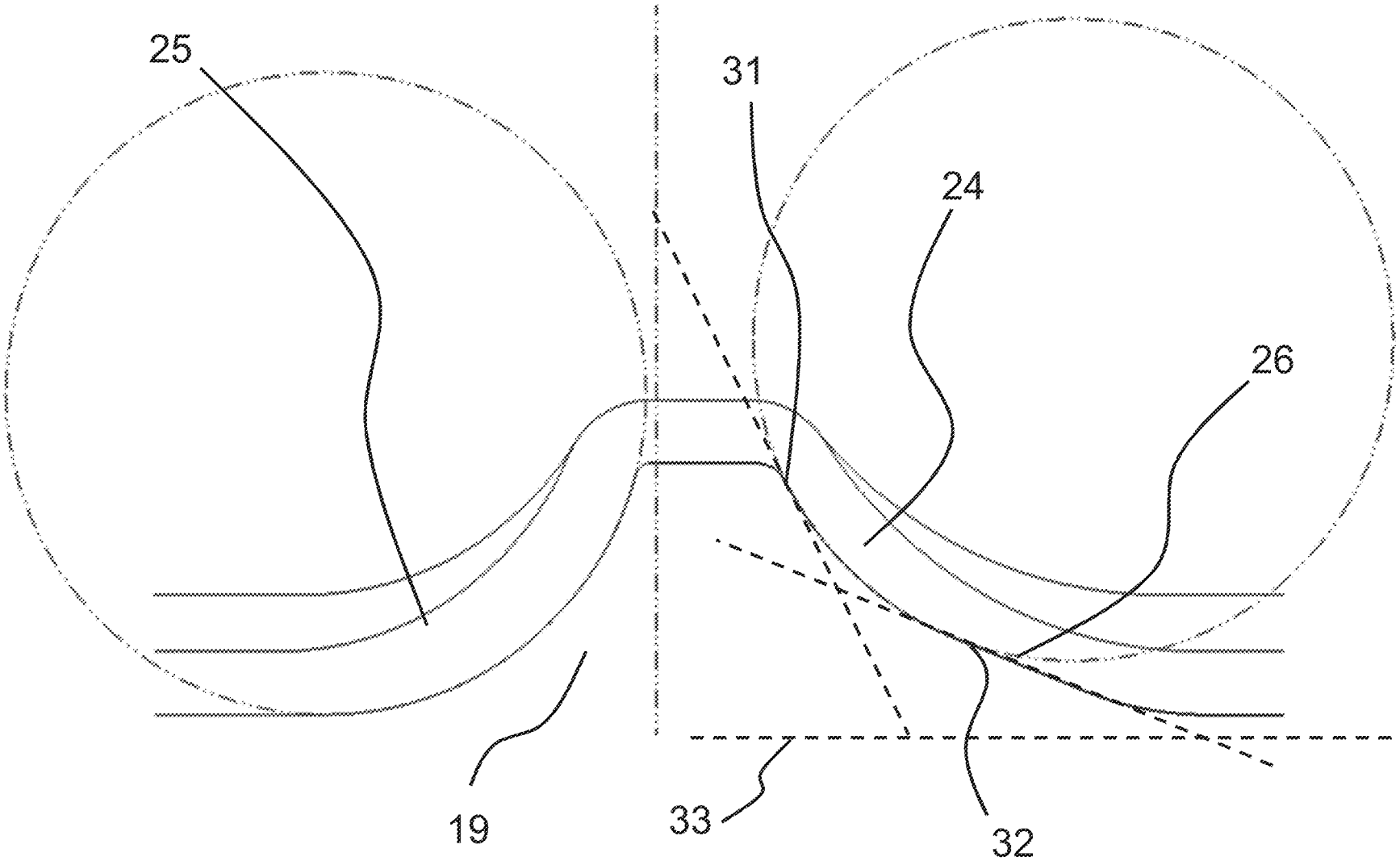
FIG. 8 shows a detailed view of the control cam of the first embodiment of the shut-off clutch.

It can be seen from FIG. 8 that the first switching contour 24 has a switching point 31, the tangential slope of which defines the release torque of the cut-off clutch 12. The pre-torque is thereby defined by the tangential slope of a pre-switching point 32, which is associated with the second switching contour 26. The tangential slope of the switching point 31 is greater than the tangential slope of the pre-switching point 32, which ultimately results in the pre-torque being less than the release torque, which is determined by the tangential slope in the switching point 31 of the first switching contour 24. In the exemplary embodiment shown, the ratio between the tangential slope of the switching point 31 and the tangential slope of the pre-switching point 32 is approximately 2:1. In this case, the angle between the tangential slope of the switching point 31 and a plane 33 that is oriented perpendicular to the drive shaft 11 is between 60° and 70°. The angle between the tangential slope of the pre-switching point 32 and the plane 33, however, is between 30° and 35°.

Figure 9:
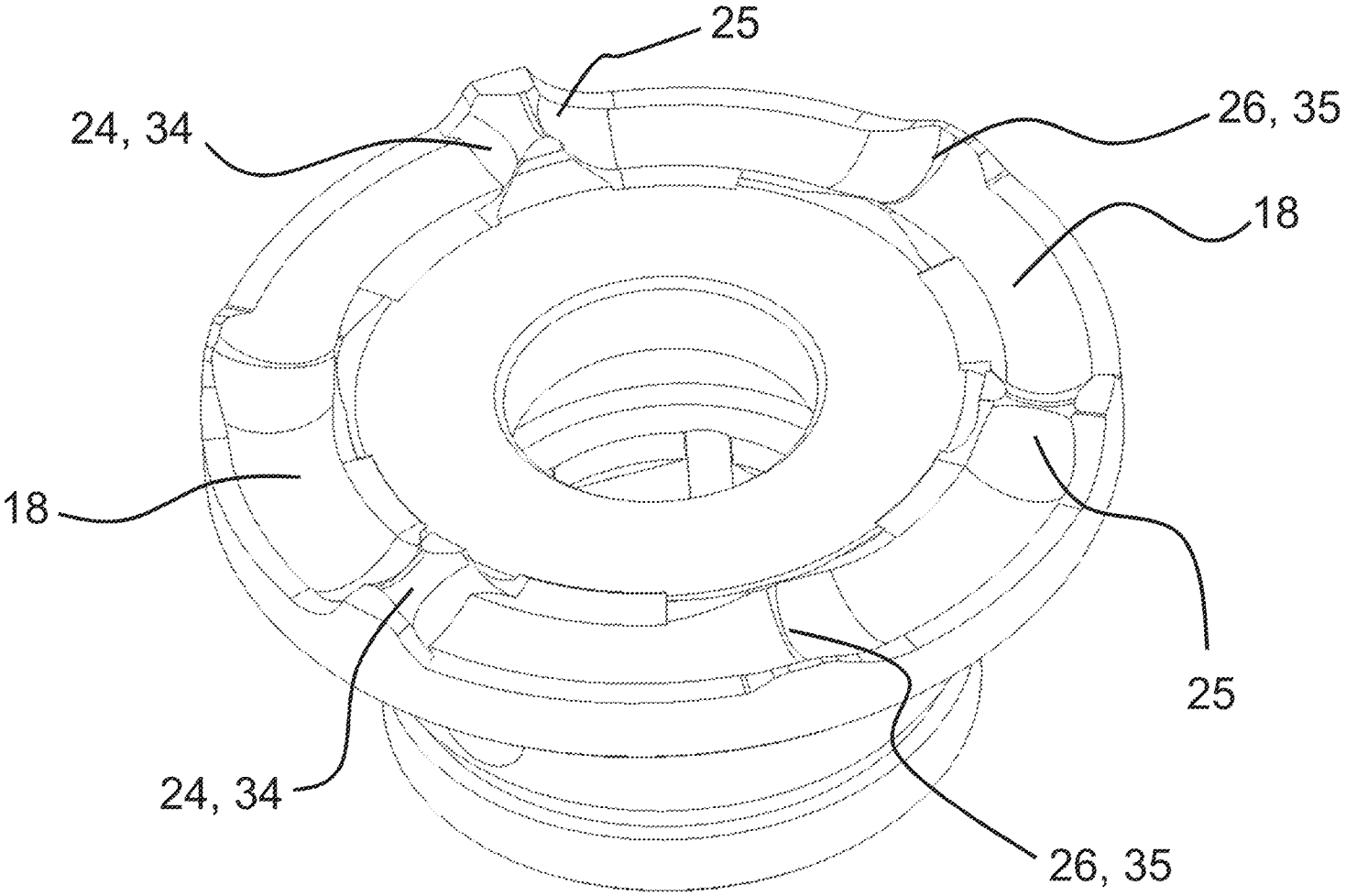
FIG. 9 is a perspective view of a control cam of a second embodiment of the shut-off clutch.

FIG. 9 shows a perspective view of a control cam 18 of a second embodiment of the shut-off clutch 12. Here, the control cam 18 has a first maximum 34, which forms the first switching contour 24 and defines the release torque, and a second maximum 35, which forms the second switching contour 26 and defines the pre-torque. The first maximum 34 is greater than the second maximum 35 and the ratio between the height of the first maximum 34 and the height of the second maximum 35 is 5:1. In addition, the slope of the flank of the first maximum 34 is greater than the slope of the flank of the second maximum 35.

Figure 10:
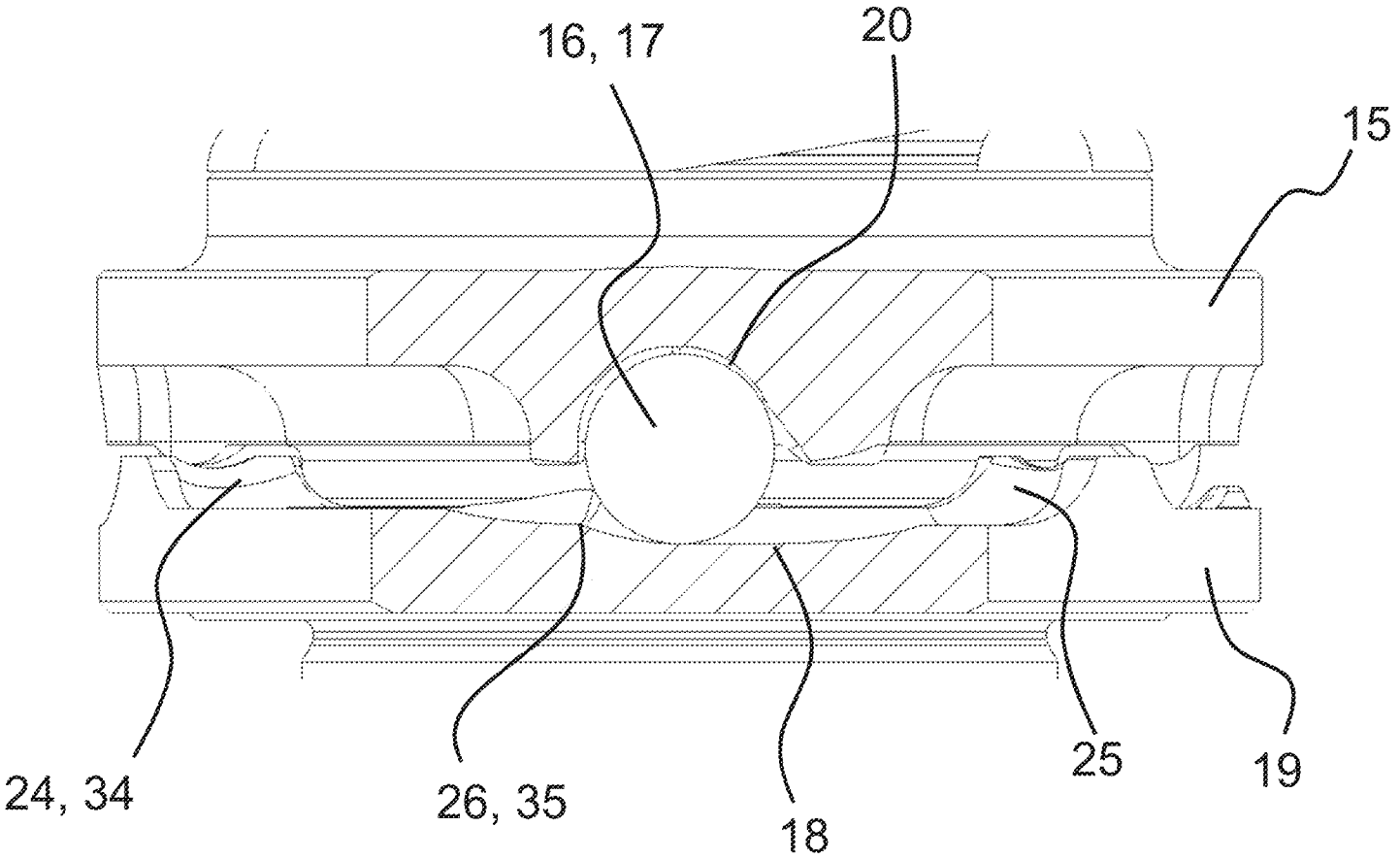
FIG. 10 shows a first switching state of the second embodiment of the shut-off clutch.
Figure 11:
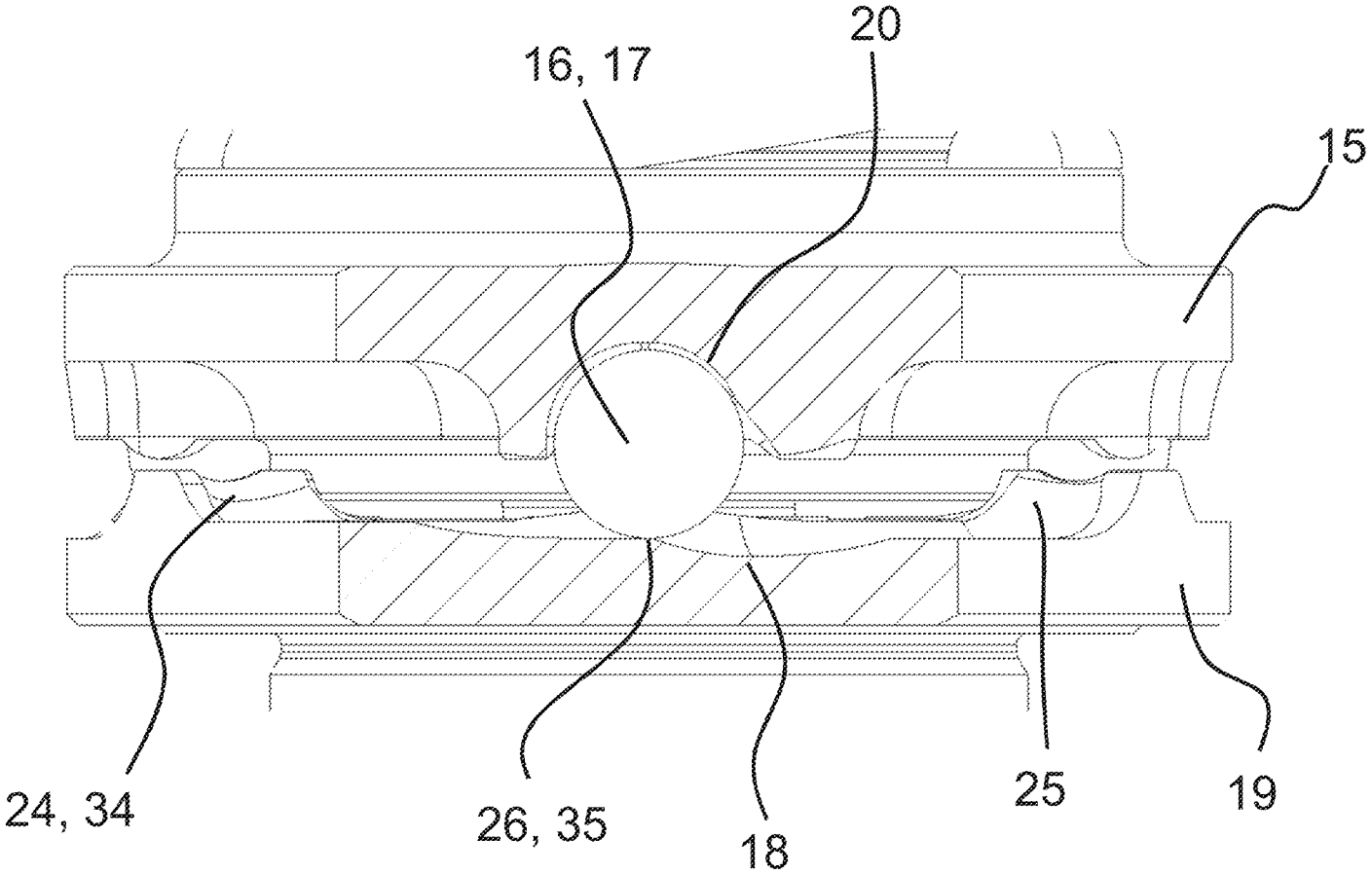
FIG. 11 shows a second switching state of the second embodiment of the shut-off clutch.

In a partially sectioned view, FIG. 10 and FIG. 11 show the axial adjustment of the control ring 15 when the applied torque exceeds the pre-torque. In this case, the switch element 16, which is formed as a switching ball 17, is adjusted by the height of the second maximum 35, which forms the pre-torque. Due to the lower height of the second maximum 35 as compared to the first maximum 34, there is also a lesser axial displacement of the control ring 15 than if the switch element 16 is adjusted by the height of the first maximum 34, which occurs when the shut-off clutch 12 is released. This difference in the axial adjustment can thus be used again in order to be able to differentiate whether the axial adjustment of the control ring 15 was carried out by the pre-torque or by the release torque.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electric portable power tool comprising:

a housing;

a drive shaft;

a control cam;

an electric drive accommodated in the housing to drive the drive shaft; and an output unit that is positively connected with the electric drive via a mechanical shut-off clutch to transfer torque from the electric drive to an insertion tool connected with the output unit, wherein the mechanical shut-off clutch comprises a control ring that is axially mounted against the force of a return spring and at least one switch element that is run on the control cam, wherein the control cam is delimited at one end by a first switching contour for providing a release torque of the mechanical shut-off clutch and by a boundary contour at another end, wherein the control cam further includes a second switching contour for providing a pre-torque which is less than the release torque, wherein the first switching contour and the second switching contour are provided on a same inclined ramp of the control cam leading to a peak, and wherein, on the inclined ramp, the first switching contour is provided by a curved incline and the second switching contour is provided by a straight incline.

2. The electric portable power tool according to claim 1, wherein the first switching contour has a switching point, a tangential slope at which defines the release torque of the mechanical shut-off clutch, and wherein the second switching contour having has a pre-switching point, a tangential slope at which defines the pre-torque, which is less than the release torque.

3. The portable power tool according to claim 2, wherein the tangential slope at the switching point is greater than the tangential slope at the pre-switching point.

4. The portable power tool according to claim 2, wherein a ratio between the tangential slope at the switching point and the tangential slope at the pre-switching point is in a range from 1.2:1.

5. The portable power tool according to claim 2, wherein an angle between the tangential slope at the switching point and a plane which is oriented perpendicular to the drive shaft is in a range from 50°.

6. The portable power tool according to claim 2, wherein an angle between the tangential slope at the pre-switching point and a plane which is oriented perpendicular to the drive shaft is in a range from 20°.

7. The portable power tool according to claim 1, wherein the control cam has a constant incline in an area of the second switching contour.

8. The portable power tool according to claim 1, wherein an amount of a derivation of a profile of the control cam in an area of the first switching contour and the second switching contour is greater than 0.

9. The portable power tool according to claim 1, wherein a second derivation of a profile of the control cam in an area of the first switching contour and the second switching contour is greater than or equal to 0.

10. The portable power tool according to claim 1, wherein a plurality of the at least one switch element and the control cam are provided.

11. The portable power tool according to claim 10, wherein a boundary contour of an adjacent second control cam is formed on the first switching contour of a first control cam.

12. The portable power tool according to claim 1, wherein the mechanical shut-off clutch comprises a cam ring connected to the drive shaft in a rotationally fixed manner, on which the control cam is formed.

13. The portable power tool according to claim 1, wherein the at least one switch element is a switching ball.

14. The portable power tool according to claim 1, wherein the return spring is a compression spring, the spring force of which is adjustable.

15. The portable power tool according to claim 1, wherein the portable power tool is a cordless screwdriver.

* * * * *